United States Patent [19]

Nishio

[11] Patent Number: 5,045,885

[45] Date of Patent: Sep. 3, 1991

[54] LINK MECHANISM PROVIDED BETWEEN AN UPPER FRAME AND A LOWER FRAME OF AN IMAGE FORMING APPARATUS

[75] Inventor: Yukio Nishio, Tama, Japan

[73] Assignee: Fujitsu Ltd., Kawasaki, Japan

[21] Appl. No.: 488,506

[22] Filed: Mar. 5, 1990

Related U.S. Application Data

[60] Continuation of Ser. No. 250,174, Sept. 9, 1988, abandoned.

[30] Foreign Application Priority Data

Oct. 5, 1987 [JP] Japan ..... 62-250992

[51] Int. Cl.[5] ..... G03G 15/00

[52] U.S. Cl. ..... 355/245; 355/200; 74/96

[58] Field of Search ..... 355/200, 210, 245, 133; 74/96

[56] References Cited

U.S. PATENT DOCUMENTS 3,689,146 9/1972 Ito et al. ..... 355/200 X
4,609,277 9/1986 Yokoyama et al. ..... 355/210 X
4,615,605 10/1986 Kida et al. ..... 355/200
4,641,947 2/1987 Ishida et al. ..... 355/200

FOREIGN PATENT DOCUMENTS 2184396 6/1987 United Kingdom .

*Primary Examiner*—R. L. Moses
*Attorney, Agent, or Firm*—Staas & Halsey

[57] ABSTRACT

In an image forming apparatus, a mechanism is provided between an upper frame and a lower frame, rotatably connected to each other so that the upper frame can be opened for separating a developing unit in the upper frame, closely united with an image forming drum in the upper frame when the developing unit operates, from the image forming drum so as to have a gap as wide as that the developing unit and/or a drum unit including the image forming drum can be mounted or demounted without damaging a cylindrical surface of the image forming drum, when the upper frame is opened for exchanging the drum unit and/or the developing unit.

11 Claims, 9 Drawing Sheets

FIG. 1 (a) PRIOR ART
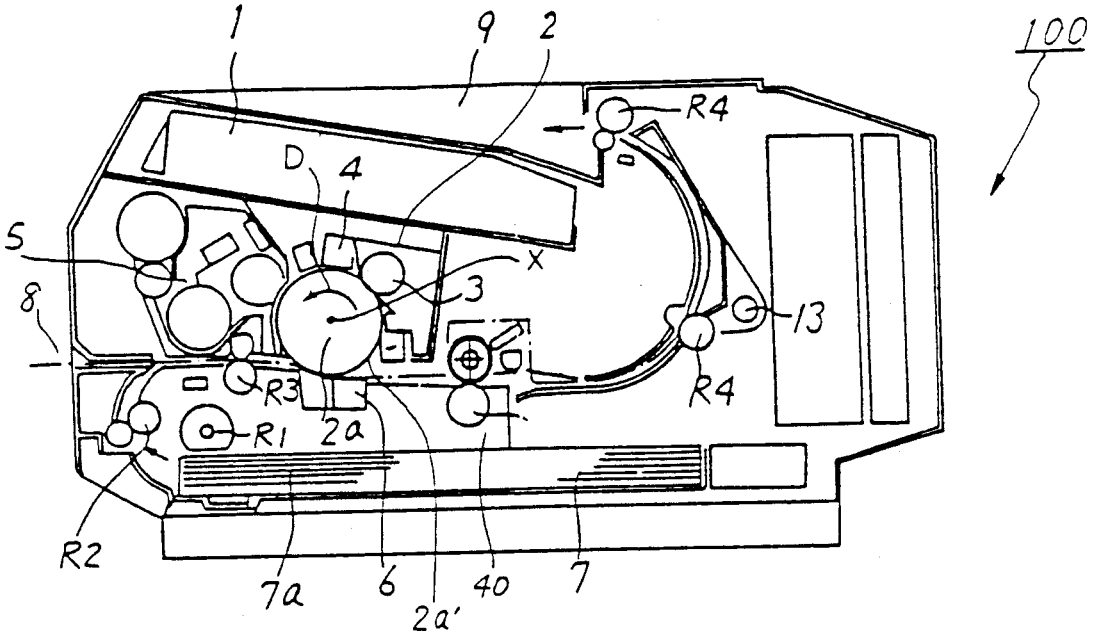
FIG. 1 (b)
PRIOR ART
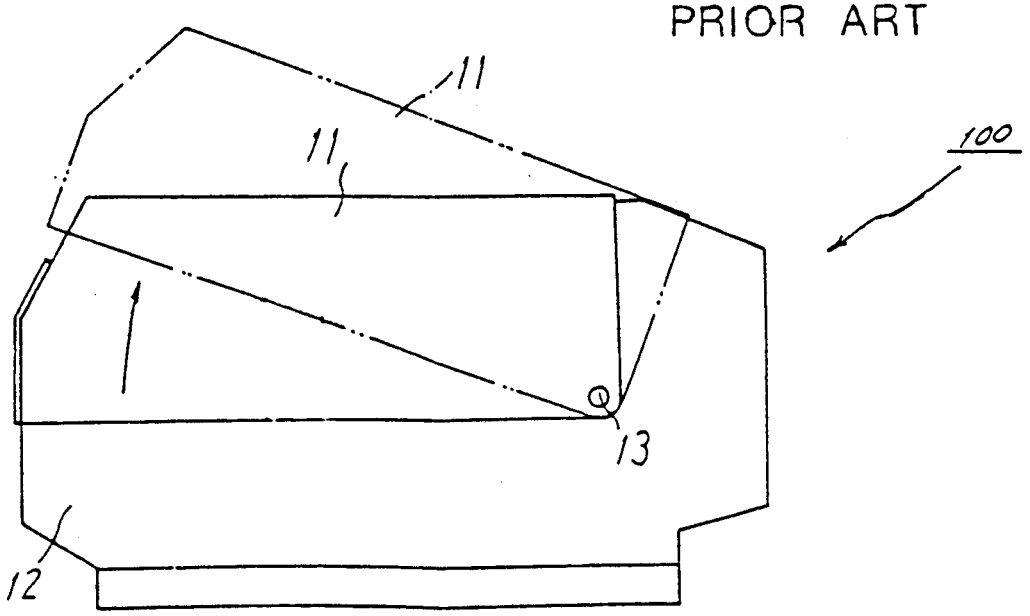

LINK MECHANISM PROVIDED BETWEEN AN UPPER FRAME AND A LOWER FRAME OF AN IMAGE FORMING APPARATUS

This is a continuation of application Ser. No. 250,174, filed on Sept. 28, 1988, now abandoned.

BACKGROUND OF THE INVENTION

1. Field of the Invention

The present invention relates to an image forming apparatus including a drum unit and a developing unit for transcribing an image onto a record sheet, and particularly to a link mechanism a linking a lower frame and an upper frame of the apparatus together for making exchange of the drum unit and/or the developing unit easy.

2. Description of the Related Art

Recently, an image forming apparatus is widely used for transcribing an image onto a recording sheet as seen in a duplicator or a facsimile apparatus and tends to be small in size and light weight.

In such image forming apparatus, a frame is mostly separated into a lower frame and an upper frame for easily exchanging units thereof. However, the units must be exchanged very carefully because the units are delicate and are installed in a small space very close to each other. Furthermore, as the image forming apparatus is used popularly, the units are required to be exchanged by users themselves without asking the help of an expert. Therefore, the image forming apparatus is required to have structure in which the units can be exchanged easily by any person and safely without damaging any unit.

For convenience of exchanging the units, some units are unified in an integrated unit, considering a balance between the lives of the units unified. Particularly, the life of the photoconductive drum, which will be called simply the "drum" hereinafter, is important to maintain a high quality of a transcribed image on the recording sheet. Therefore, the drum is generally unified in the integrated unit called a drum unit, unifying other units associated with the drum.

In the image forming apparatus, an image is transcribed on the recording sheet as follows: an electrical image signal to be transcribed is fed to the image forming apparatus; the drum is rotated and a cylindrical surface of the drum is electrostatically charged by a charging unit; a latent image is formed on the charged cylindrical surface by an optical beam projected from a projecting unit, wherein the optical beam is modulated by the electrical image signal; the latent image is developed by a developing unit, producing a toner image on the cylindrical surface; the toner image on the cylindrical surface is transcribed onto the recording sheet by a image transcription unit; a transcribed toner image on the recording sheet is fixed by a fixing unit; and the toner left on the cylindrical surface is cleaned by a cleaning unit and kept rotating for the next image transcription. The recording sheet is fed to the image transcription unit and sent to the fixing unit by a sheet transferring mechanism. The drum, the charging unit and the cleaning unit are unified to an integrated unit called a drum unit. The drum unit and the developing unit are usually installed in the upper frame, and the image transcription unit and the fixing unit are installed in the lower frame.

In the image forming apparatus operating as mentioned above, a gap between the cylindrical surface and the developing unit and a gap between the cylindrical surface and the image transcription unit are very important for producing a high quality of the recorded image. Therefore, the developing unit and the image transcription unit are placed against the cylindrical surface so as to have a designated constant gap respectively, by inserting rollers belonged to the units respectively, between the cylindrical surface and the units. The rollers will be called gap rollers hereinafter.

As a result, when the developing unit and/or the drum unit is exchanged, the upper frame is opened from the lower frame and then the developing unit and the drum unit are separated from each other so that the gap rollers belonged to the developing unit are parted from the cylindrical surface. In a case of the image transcription unit, the separation process as mentioned above is unnecessary to be performed because the drum unit and the image transcription unit are separated when the upper frame is opened from the lower frame.

In the prior art, when the separation process of the drum unit and the developing unit is performed in the upper frame, the developing unit must be parted from the drum unit by loosening the developing unit manually as disclosed in Japanese laid open Utility Model Application 60-51554, from the upper frame manually. That is, when the drum unit is required to be exchanged for example, the following steps must be carried out in the prior art: firstly opening the upper frame from the lower frame; secondly loosen fastening means such as levers having fastened the developing unit to the upper frame moving the developing unit so that the gap rollers belonging to the developing unit are parted from the cylindrical surface of the drum against a force pushing the developing unit toward the cylindrical surface; and removing the drum unit from the upper frame. These steps have been very inconvenient to carry out for the general user.

SUMMARY OF THE INVENTION

Therefore, an object of the present invention is to improve the separation process of the developing unit from the drum unit so as to be done easily by the general users.

Another object of the present invention is to improve a removing process of the developing unit and/or the drum unit from the image forming apparatus so as to be done safely without damaging the cylindrical surface of the drum by the gap rollers attached to the developing unit.

Still another object of the present invention is to improve the separation process and the removing process of the drum unit and/or the developing unit so as to be done by the general users certainly without paying special attention.

The above objects are achieved by providing a link mechanism between the upper frame and the lower frame of the image forming apparatus, passing near by connecting means for connecting the upper frame and the lower frame, and by making the link mechanism move the developing unit when the upper frame is opened, so that the gap rollers belonged to the developing unit and inserted between the cylindrical surface of the drum and the developing unit are parted from the cylindrical surface. Applying thus the link mechanism to the image forming apparatus, when the upper frame is opened, the gap rollers of the developing unit are automatically parted from the cylindrical surface of the drum, so that the exchange of the developing unit and/or the drum unit can be carried out easily by any user and the cylindrical surface is never damaged by the gap rollers when the developing unit or the drum unit is removed.

BRIEF DESCRIPTION OF THE DRAWINGS

FIG. 1(*a*) is an inside side view of the prior art image forming apparatus;

FIG. 1(*b*) is an outer side view of the prior art image forming apparatus illustrating opening the upper frame;

FIG. 4(*b*) is a link mechanism in an open state of the upper frame;

FIG. 4(*c*) is a schematic illustration of the link mechanism;

FIG. 6(*b*) is a schematic partial-side view of the developing unit and the drum for illustrating the function of the flat spring when the upper frame is opened;

FIG. 8(*b*) is a schematic plan view after insertion of the developing unit into the guide rails;

FIG. 9(*b*) is a schematic plan and a side view when the gap rollers are apart from the cylindrical surface of the photoconductive drum, corresponding a state which the upper frame is opened; and FIG. 9(*c*) is a schematic plan and a side view corresponding a state which the developing unit is being drawn.

DESCRIPTION OF THE PREFERRED EMBODIMENTS

Figure 2:
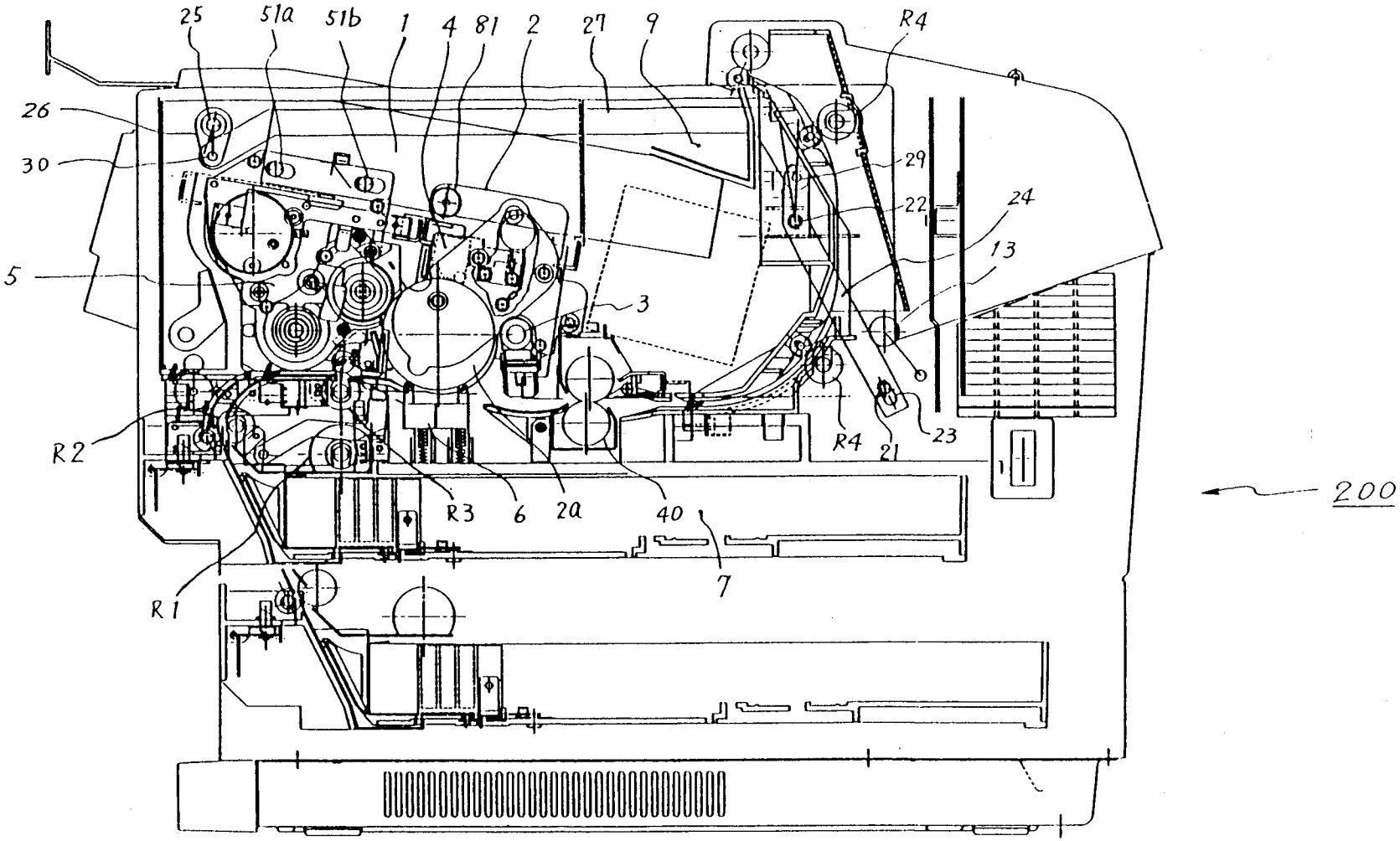
FIG. 2 is an inside side view of the image forming apparatus when the upper frame is closed.

Before describing a preferred embodiment of the present invention, the image forming apparatus of the prior art will be described for the sake of explaining the embodiment.

An inside side view of the prior art image forming apparatus 100 is illustrated in FIG. 1(*a*), showing the units installed therein. The units function for transcribing images onto recording cut sheets when the image forming apparatus 100 receives (electrical) image signals to be transcribed. That is, when an image signal to be transcribed to an image is sent to the image forming apparatus 100, an electrical unit, which is not shown in FIG. 1(*a*), controls the units so as to transcribe the image onto a cut sheet in response to the image signal. The following steps proceed among the units for transcribing the image.

When the image forming apparatus 100 receives the image signal, pick up rollers R1 pick up a recording cut sheet 7*a*, which will be simply called a "cut sheet 7*a*" hereinafter, set in a sheet cassette 7, and the cut sheet 7*a* is sent to a standby roller R3 by driving rollers R2. As the need arises, a single cut, sheet can be used by inserting into an inserting opening one by one.

At the same time, the toner image is formed on a cylindrical surface of the photoconductive drum as follows: a photoconductive drum 2*a*, which will be simply called a "drum 2*a*" hereinafter, starts to rotate and rotates constantly around an axis X until a train of the image signals is over; a cylindrical surface 2*a*′ of the drum 2*a* is electrostatically charged by a charging unit 4; an optical beam is produced from an optical unit 1 in response to the image signal and projected onto the charged cylindrical surface 2*a*′, producing a latent image on the cylindrical surface 2*a*′; and the latent image is developed by a developing unit 5, forming a toner image on the cylindrical surface 2*a*′ in response to the latent image.

Then, the cut sheet 7*a* having stood by at the standby roller R3 is sent to an image transcription space provided between the cylindrical surface 2*a*′ and an image transcription unit 6, where the toner image on the cylindrical surface 2*a*′ is transcribed onto the cut sheet 7*a*. After the image transcription, a toner image on the cut sheet 7*a* is fixed at a fixing unit 40 and ejected to a stacker 9 through ejecting rollers R4.

Toner left on the cylindrical surface 2*a*′ after the image transcription is removed at a cleaning unit 3 for cleaning the cylindrical surface 2*a*′. Then the cylindrical surface 2*a*′ is used for the image transcription on the next cut sheet 7*a*, thus repeat the charging, projecting, developing and transcribing steps.

In FIG. 1(*a*), the drum 2*a*, the charging unit 4 and the cleaning unit 3 are unified to a drum unit 2. The drum unit 2, the optical unit 1, the developing unit 5, the ejecting rollers R4 and the stacker 9 are installed in the upper frame 11, and the sheet cassette 7, the pick up roller R1, driving roller R2, the standby roller R3, the image transcription unit 6 and the fixing unit 40 are installed in the lower frame 12.

The upper frame 11 and the lower frame 12 are connected by hinges 13 by which the upper frame is opened, leaving the lower frame as it is as shown in FIG. 1(*b*), when units are required to be exchanged. A one dot chain line 10 in FIG. 1(*a*) shows a boundary of the upper frame 11 and the lower frame 12. Since the gaps provided between the cylindrical surface 2*a*′ and the developing unit 5 and the cylindrical surface 2*a*′ and the image transcription unit 6 are very important to maintain a high quality of the image transcription, the gaps must be constantly kept at designated values respectively. Because of this, these units 5 and 6 are positioned close to the cylindrical surface 2*a*′ through the gap rollers which are not depicted in FIG. 1(*a*). When the upper frame 11 is opened, the cylindrical surface 2*a*′ is parted from the image transcription unit 6, so that there is no problem to damage the cylindrical surface 2*a*′ when the drum unit 2 or the image transcription unit is removed from the image forming apparatus 100. However, when the drum unit 2 or the developing unit 5 is required to be removed from the upper frame 11, the units 5 and 2 must be parted from each other. If the drum unit 2 or the developing unit 5 were tried to be removed without parting each other, the cylindrical surface 2a' would be damaged by the gap rollers contacted with the cylindrical surface 2a'. Therefore, in the past, the developing unit 5 was moved manually so as to be parted from the drum unit 2 before removing the developing unit 5 or the drum unit 2 out from the upper frame 11. This removal has been difficult for the general user, and sometimes damage to the cylindrical surface 2a' has occurred.

An image forming apparatus 200 embodying the present invention will be described in reference to FIGS. 2 to 8.

In FIGS. 2 to 8, the same reference numeral as in FIGS. 1(a) and 1(b) designates the same unit or part as in FIGS. 1(a) and 1(b), and through FIGS. 2 to 8, the same reference numeral designates the same unit or part.

Figure 3:
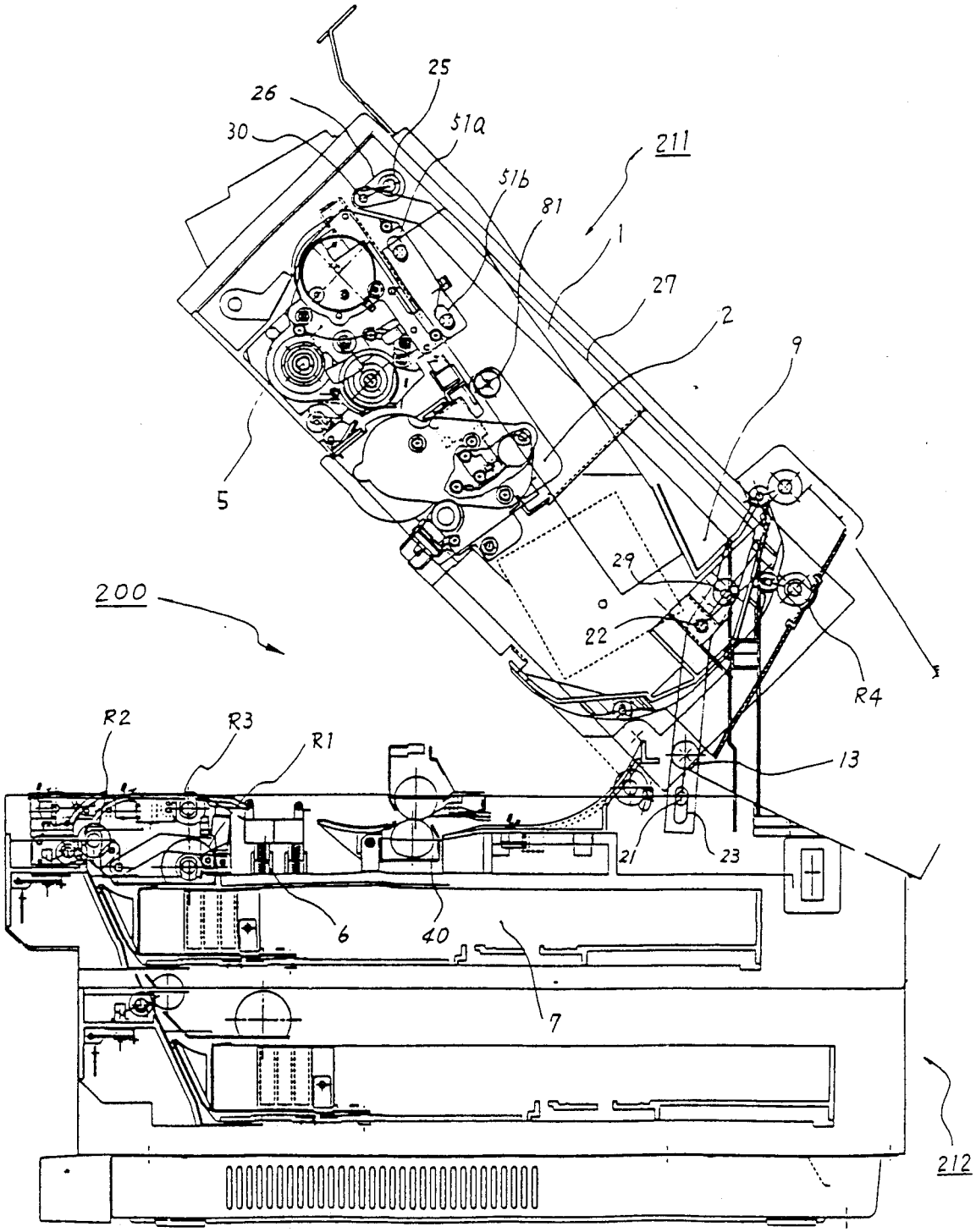
FIG. 3 is an inside side view of the image forming apparatus when the upper frame is opened.

A frame of the image forming apparatus 200 is separated into an upper frame 211 and a lower frame 212 and connected by hinges 13 so that the upper frame 211 can be opened, leaving the lower frame 212 as it is. The inside side view of the image forming apparatus 200 is illustrated in FIGS. 2 and 3, showing states that the upper frame is closed in FIG. 2 and opened in FIG. 3 respectively. Similarly to the prior art image forming apparatus 100, the drum unit 2, the developing unit 5, the optical unit 1, ejecting rollers R4 and the stacker 9 are installed in the upper frame 211, and the sheet cassette 7, the pick up rollers R1, the driving rollers R2, the standby roller R3, the image transcription unit 6 and the fixing unit 40 are installed in the lower unit 212.

As a point of the present invention, a link mechanism is provided between the upper frame 211 and the lower frame 212 as shown in FIGS. 2 and 3. The link mechanism is for moving mechanically the developing unit 5 so that the developing unit 5 is parted from the cylindrical surface 2a' of the drum 2a in the drum unit 2 when the upper frame 211 is opened.

The motion of the link mechanism 70 is shown in FIGS. 4(a) and 4(b). FIG. 4(a) illustrates the link mechanism in a close state of the upper frame 211, and FIG. 4(b) illustrates the open state. The link mechanism 70 is composed of two levers 24 and 26 and a link member 27, a fixed axis 22 and two rotation axes 22 and 25 fixed to the upper frame 211 and two link joints 29 and 30 in the upper frame 211 and a fixed axis 21 fixed to a vertical wall 212a in the lower frame 212. Wherein, the link joints 29 and 30 are for rotatably connecting the lever 24 and the link member 27 and the lever 26 and the link member 27 respectively. The fixed axes 22 and 21 are positioned in a direction being upper left and lower right, respectively, from the hinge 13 when the upper frame 211 is closed. These positions are effective to perform the link motion smoothly. The lever 24 has a long arm 24a extended toward the lower frame 212 from the rotation axis 22; the long arm 24a has a slot 23 at the end thereof; and the rotation axis goes through the slot 23. As a result, the motion of the lever 24 is limited so as to be moved only along the slot 23. A rotation axis 25 is provided near the front upper corner of the upper frame 211.

FIG. 4(c) illustrates a function of the link mechanism 70 schematically. In FIG. 4(c), a lower polygonal solid line represents the link motion of the link mechanism 70 when the upper frame 211 is shut and an upper polygonal solid line represents the that when the upper frame 211 is opened as shown by an arrow B. The reference numerals for the upper polygonal solid line are represented by adding the prime to the corresponding respective reference numeral for the lower polygonal solid line.

In FIG. 4(c), an angle $P_1$ made by a line between the fixed axes 22 and 13 and a line between the fixed axis 22 and the joint axis 21 is smaller than an angle $P_2$ made by a line between the fixed axes 22' and 13 and a line between the fixed axis 22' and the joint axis 21. This is because the lever 24 is rotated counter clockwise around the fixed axis 22 as indicated by an arrow C. Accordingly, the link member 27' is pushed in a forward direction as indicated by an arrow G. An angle $Q_2$ made by a line between the fixed axes 25' and 13 and a line of the second lever 26' is larger than an angle $Q_1$ made by a line connecting the fixed axes 25 and 13 and a line of the lever 26. This means that the lever 26 rotates clockwise around the fixed axis 25' as indicated by an arrow E.

Figure 5:
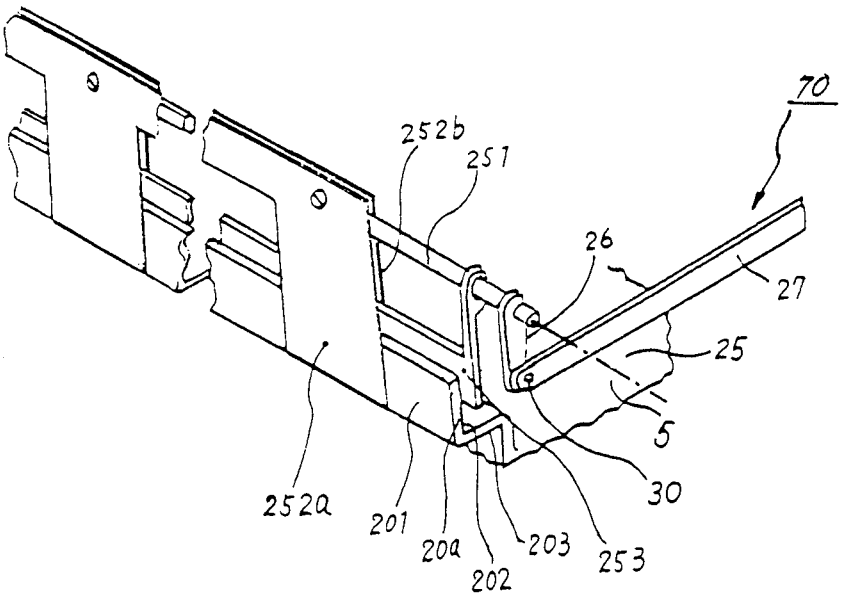
FIG. 5 is a perspective view of the structure around the shaft with flat springs for illustrating the action of the shaft.

As a result, a shaft 251 having the fixed axis 25' rotates in the same direction as indicated by the arrow E, which results in separating the developing unit 5 from the cylindrical surface 2a' of the drum 2a, as shown in FIG. 5.

FIG. 5 is a perspective view of the structure around the shaft 251 for illustrating the action of the shaft 251. In FIG. 5, a first flat spring 252a and a second flat spring 252b are fixed to the shaft 251 and a spacer 253 is attached to the shaft 251 freely so as to be inserted between the first and second flat spring 252a and 252b. Two L-shaped guides 20a and 20b are attached to the developing unit 5 for sliding the developing unit 5 into the upper frame 211 of the image forming apparatus 200. When the developing unit 5 is mounted on the upper frame 211, one of the L-shaped guides, which is the L-shaped guide 20a, is placed so as to be positioned between the first spring 252a and the spacer 253, and when the upper frame is closed the first spring 252a pushes the guide 20a, touching the outer surface 201 of the L-shaped guide 20a, until the gap rollers of the developing unit 5 touch the cylindrical surface 2a' of the drum 2a. This situation is shown in FIG. 5. The first flat spring 252a has a function to push the gap rollers of the developing unit 5 to the cylindrical surface 2a' of the drum 2a. As a result, the developing unit 5 can be movable following the cylindrical surface 2a' of the drum 2a, even though the drum 2a rotates eccentrically.

These flat springs 252a and 252b work as the levers engaged in the guide 20a; the first flat spring 252a is for pushing the developing unit 5 toward the cylindrical surface 2a', as described above, and the second flat spring 252b is for pulling the developing unit 5 so that the developing unit 5 is parted from the cylindrical surface 2a'. The spacer 253 is for reducing the friction between the inner surface 202 of the guide 20a and the flat spring 252b when the upper frame 211 is opened and the developing unit 5 is mounted or removed in or from the upper frame 211.

FIGS. 6(a) and 6(b) show the schematic partial-side views of the developing unit 5 and the drum 2a, for illustrating the function of the flat springs 252a and 252b and the spacer 253 when the upper frame 211 is closed and opened respectively. In FIGS. 6(a) and 6(b), the guides 20a nd 20b are slided on the upper surfaces of guide rails 32a and 32b attached to the upper frame 211.

Figures 9A, 9B, 9C:
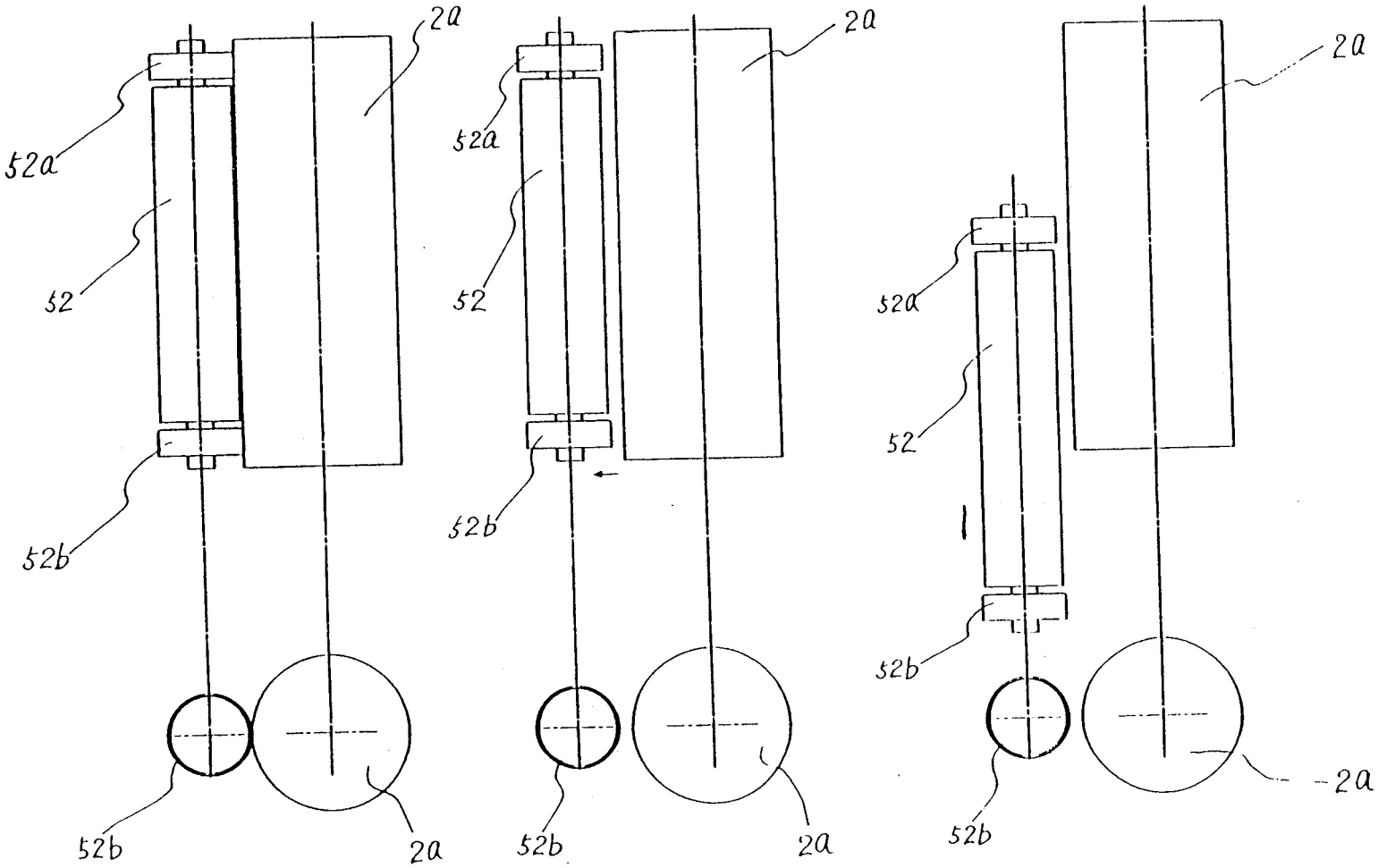
FIG. 9(*a*) is a schematic plan and a side view when the gap rollers touch the cylindrical surface of the photoconductive drum, corresponding a state which the upper frame is closed.

In FIG. 6(a), the upper frame 211 is closed, so that the link mechanism 70 is in the state as shown in FIG. 4(a). Accordingly, the first flat spring 252a pushes the guide 20a and the second flat spring 252b is in a state parted from the guide 20*a*. Therefore, the spacer 253 is free from the guide 20*a* and the second flat spring 252*b*. In this state, the developing unit 5 is pushed to the cylindrical surface 2*a'* of the drum 2*a* through the gap rollers 52*a* and 52*b*, which are provided coaxially with a magnetic roller 52 of the developing unit 5, as shown in FIG. 9(*a*).

Figure 4:
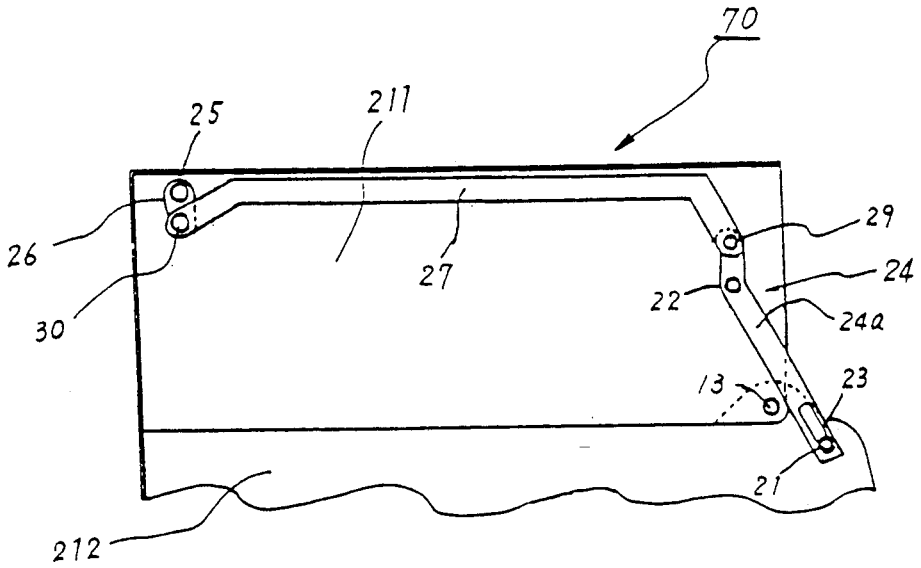
FIG. 4(*a*) is a link mechanism in a close state of the upper frame.
Figure 4:
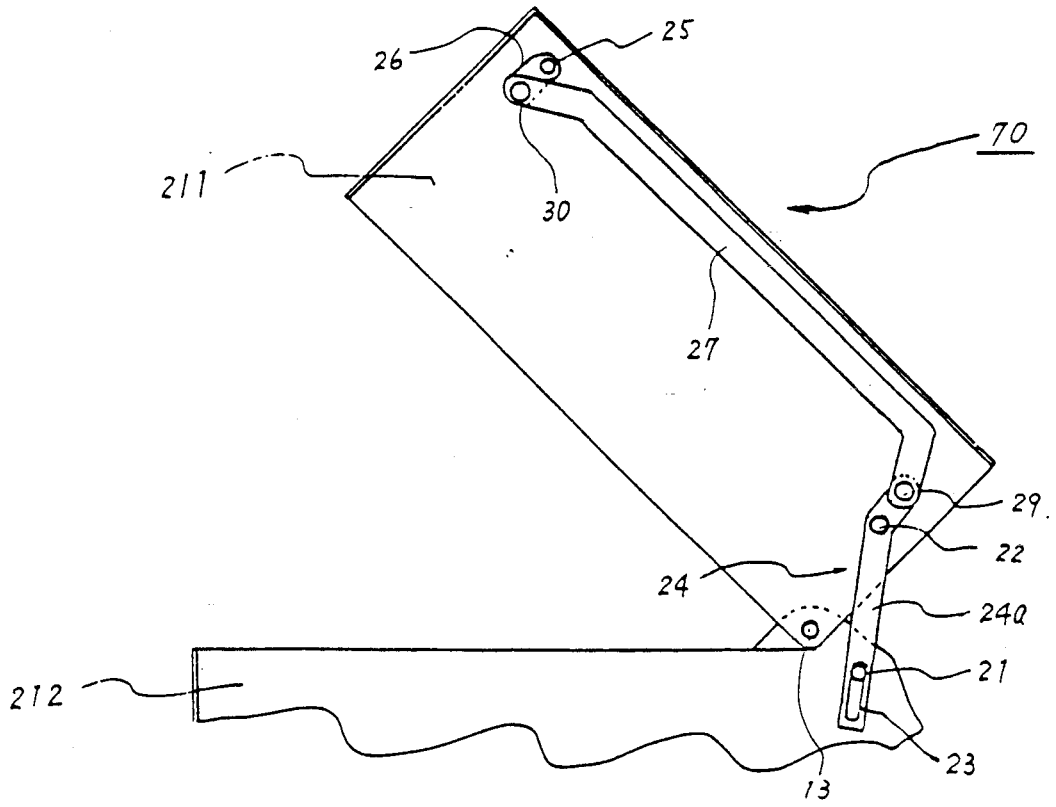
Figure 4:
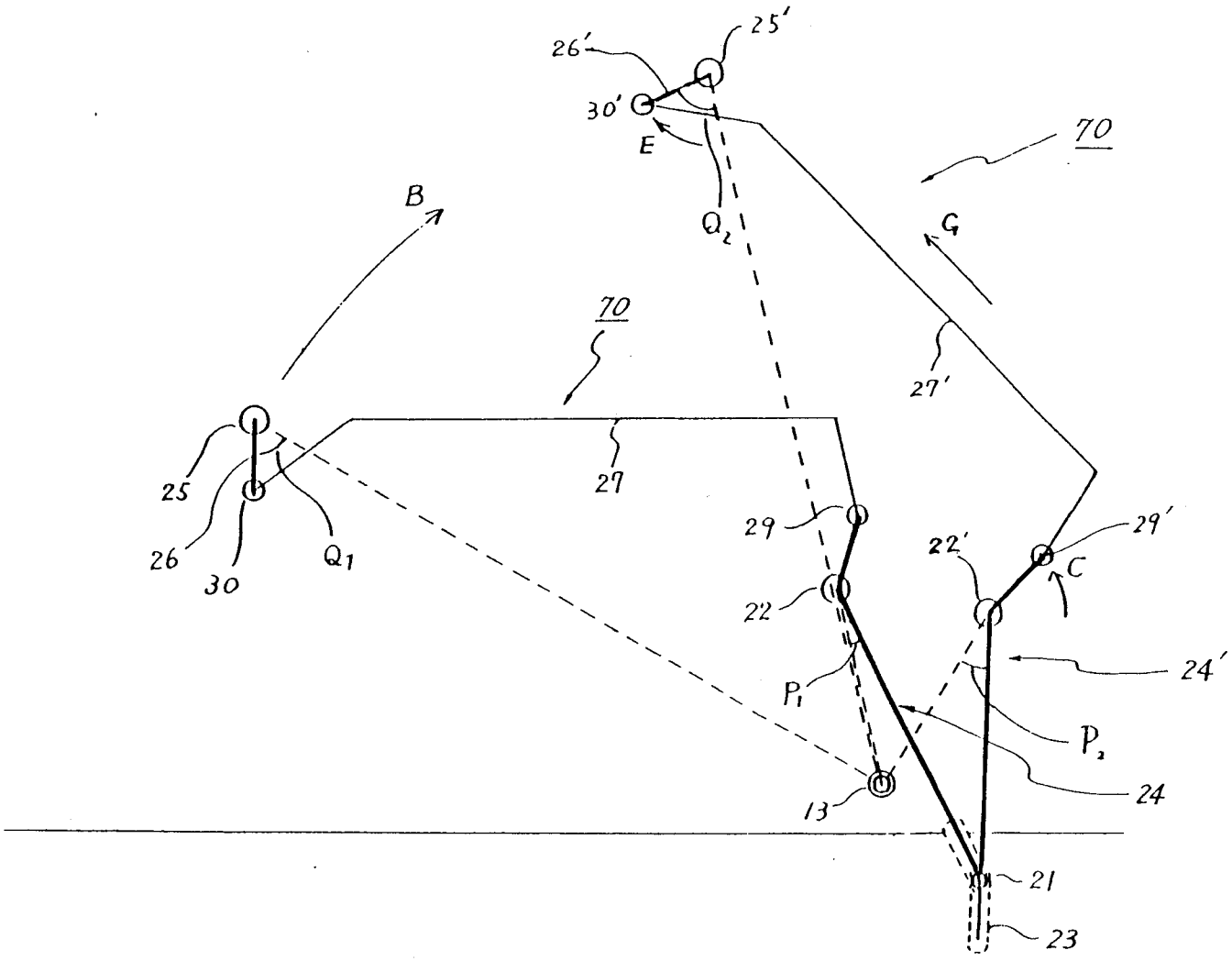
Figure 6:
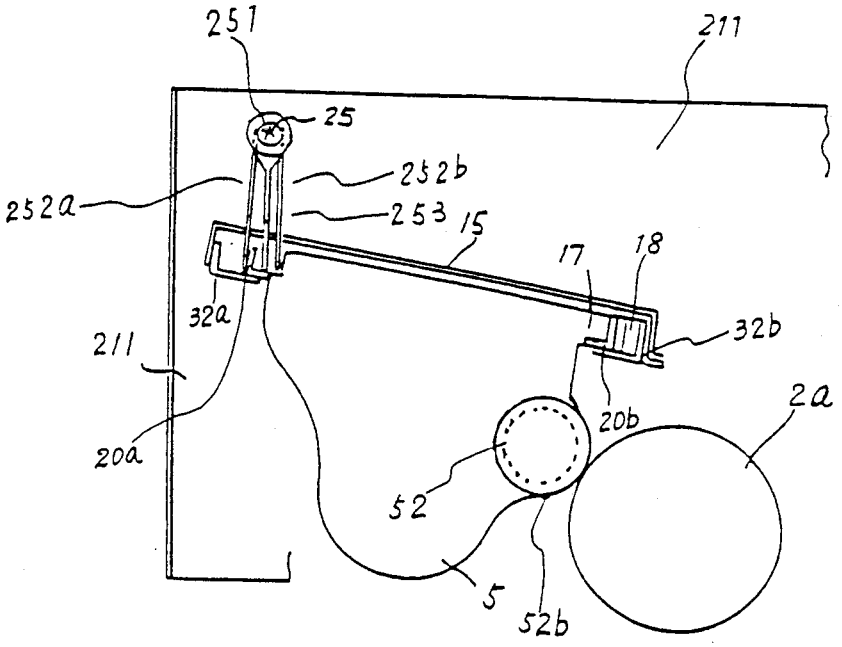
FIG. 6(*a*) is a schematic partial-side view of the developing unit and the drum for illustrating the function of the flat spring when the upper frame is closed.
Figure 6:
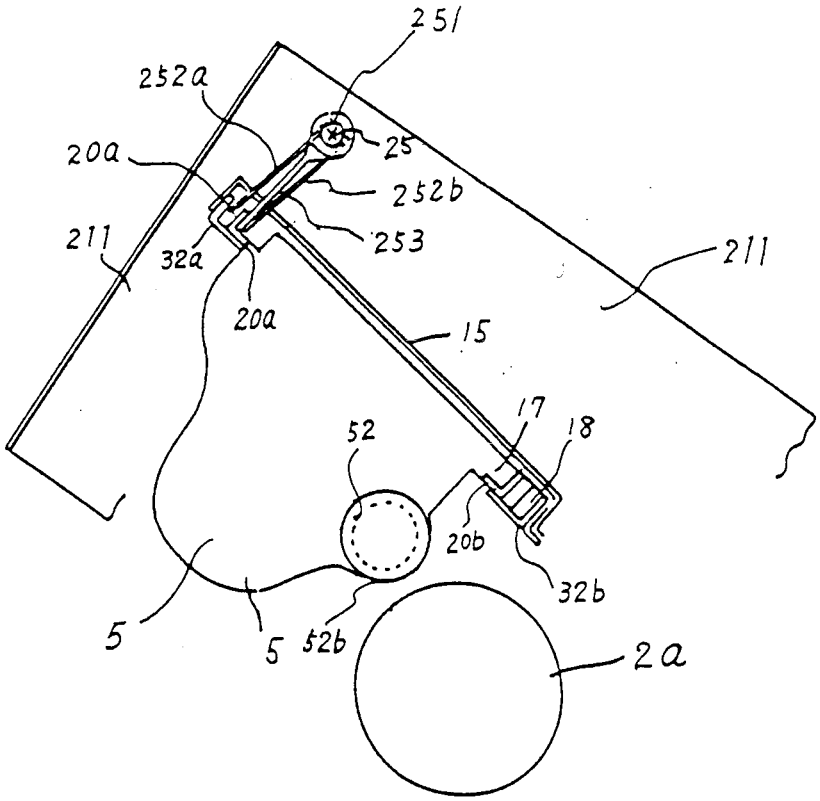

In FIG. 6(*b*), the upper frame 211 is opened, so that the link mechanism 70 is in the state as shown in FIG. 4(*b*). Accordingly, the second flat spring 252*b* pushes the guide 20*a* through the spacer 253 inserted between the guide 20*a* and the second flat spring 252*b*, and the first flat spring 252*a* is parted from the guide 20*a*, so that the developing unit 5 is parted from the cylindrical surface 2*a'*. In this state, the developing unit 5 can be draw out from the upper frame 211. In this case, since the spacer 253 is inserted between the second flat spring 252*b* and the guide 20*a*, the friction due to the pushing force of the second flat spring 25*b* can be reduced, which results in making the removal of the developing unit 5 from the upper frame 211 easy, avoiding the damage of the inner surface 202 (in FIG. 5) of the guide 20*a*. The spacer 253 is also effective to facilitate mounting the developing unit 5 onto upper frame 211, avoiding the damage to the inner surface 202.

Figure 7:
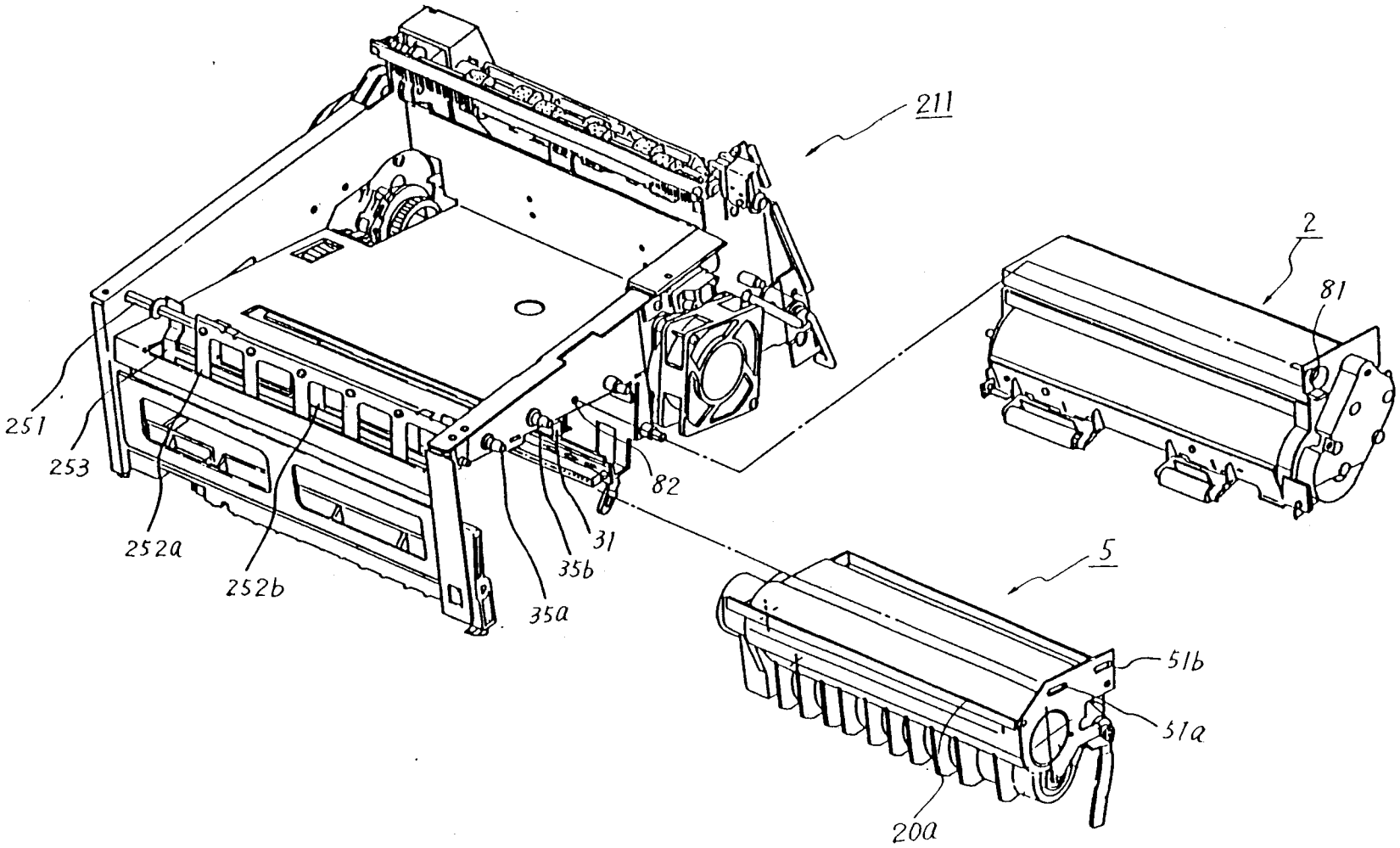
FIG. 7 is a perspective view of the uncovered upper frame and that of the drum unit and the developing unit which are drawn out from the upper frame.

FIG. 7 shows a perspective view of the upper frame 11, removing a case from the upper frame 211, for illustrating the removed state of the developing unit 5 and the drum unit 2 from the upper frame 211. The developing unit 5 is mounted by sliding the developing unit 5 into the upper frame 211 using the guide rails 32*a* and 32*b*, which are not indicated in FIG. 7, and the guides 20*a* and 20*b*, which is not indicated in FIG. 7, respectively The developing unit 5, is held by two guide pins 35*a* and 35*b*, provided to the upper frame 211, penetrating through two slide holes 51*a* and 51*b* provided to the developing unit 5. The drum unit 2 is mounted and fixed to the upper frame 211 by screwing a screw 81 into a screw hole 82. The mounting of the developing unit 5 and/or the drum unit 2 can be performed only when the upper frame 211 is opened as explained above.

Figure 8:
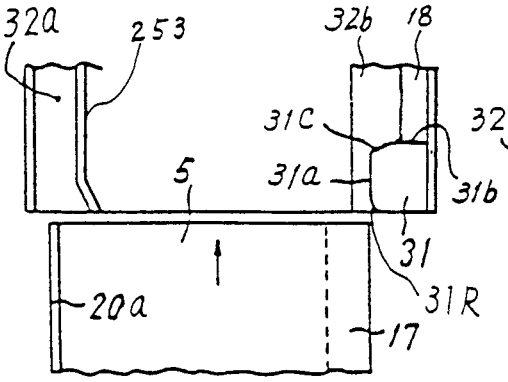
FIG. 8(*a*) is a schematic plan view immediately before insertion of the developing unit into the guide rails provided in the upper frame.
Figure 8:
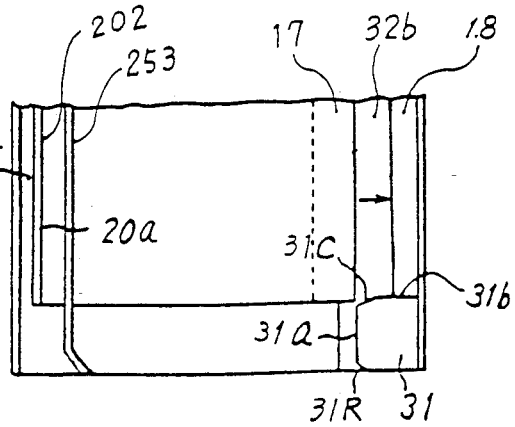

FIGS. 8(*a*) and 8(*b*) show schematic partial plan views of the developing unit 5 and a part of the upper frame for mounting the developing unit 5, before and after the developing unit 5 is mounted in the upper frame 211, respectively. A stopper 31 made of polytetrafluoroethylene (TEFLON) is provided at an entrance of the right guide rail 32*b*. The stopper is a cubic block and has a beveled portion 31R on the surfaces 31*a* of the stopper 31 parallel to the guide rail 32*b* and a beveled portion 31*c* on the surface 31*b* of the stopper 31 perpendicular to the guide rail 32*b*. The edge of the spacer 253 is bent so as to make insertion of the guide 20*a* easy. On account of these facts, the developing unit 5 can be inserted into the upper frame 211 smoothly.

When the upper frame 211 begins to close, the surface 201 of the guide 20*a* is pushed in a direction to the cylindrical surface of the drum 2*a* and hence the developing unit 5 is guided and positioned to a regular position by the surface 31*b* of the stopper 31. In this case, the beveled surface 31*c* make the developing unit 5 easy to move to get the regular position in the axial direction of the drum 2*a*. When the upper frame 211 is completely closed, the gap rollers attached to the developing unit 5 touch the cylindrical surface 2*a'* where the latent image is formed. In this case, the stopper 31 acts as a stopper to prevent the developing unit 5 from slipping off the guide rails 32*a* and 32*b*.

As the special case, if the upper frame 11 is closed without the drum unit 2, the developing unit 5 is positioned by a stopper 18.

FIG. 9(*a*), 9(*b*) and 9(*c*) are schematic plan views and side views of the gap rollers 52*a* and 52*b*, the magnetic rollers 52 and the drum 2*a*.

In FIG. 9(*a*), the developing unit 5 completely touches the cylindrical surface 2*a'* through the gap rollers 52*a* and 52*b* touching both ends of the cylindrical surfaces 2*a'*, avoiding touching the inner photoconductive layer of the cylindrical surface 2*a'*. This corresponds to a case that the upper frame 211 is completely closed. In this case, the magnetic roller 52 is faced to the cylindrical surface 2*a'* with a small gap, so that the toner image is produced corresponding to the latent image.

When the upper frame 211 is opened, the developing unit 5 is parted from the cylindrical surface 2*a'*, separating the gap rollers 52*a* and 52*b* from the cylindrical surface 2*a'* as shown in FIG. 9(*b*). Accordingly, the developing unit 5 can be removed from the upper frame 211 as shown in FIG. 9(*c*), without making the gap rollers 52*a* and 52*b* touch the cylindrical surface 2*a'*.

What is claimed is:

1. An image forming apparatus for transcribing a toner image produced on the rotating surface of an image forming drum onto a recording medium, said image forming apparatus comprising:

a developing unit for visualizing the toner image on the image forming drum by developing an electrostatic image formed on the image forming drum, said developing unit being juxtaposed the image forming drum so as to produce a first gap between said developing unit and the image forming drum at a predetermined value when an upper and a lower frame are closed relative to each other;

said upper frame supporting the image forming drum and said developing unit;

said lower frame being pivotally connected to said upper frame so that said upper frame is openable, leaving said lower frame stationary, said lower frame including first connecting means for rotatably connecting said upper frame and said lower frame; and link means pivotally coupled to both said upper and lower frames for moving said developing unit away from the image forming drum, when said upper frame is opened, the link means being expandable and contractible in accordance with movement of the upper frame so as to produce a second gap between said developing unit and the image forming drum, said second gap being sufficiently wide to permit the developing unit and the image forming drum to be dismounted from or mounted to said upper frame without contacting each other.

2. An image doming apparatus according to claim 1, wherein said upper frame further comprises:

first mounting means for mounting and demounting said developing unit into and from said upper frame respectively in a first direction parallel with a rotational axis of the image forming drum; and second mounting means for allowing said developing unit to be moved in a second direction perpendicular to the first direction when said developing unit is united with the image forming drum, having the first gap between said developing unit and the image forming drum.

3. An image forming apparatus according to claim 2, wherein said link means comprises:

a first lever rotatably attached to said upper frame by second connecting means positioned near and above the first connecting means, said first lever having a first arm short from the second connecting means and a second arm long from said second connecting means, said first arm having third connecting means at the end thereof, said second arm having a slide hole at the end thereof, through which fourth connecting means attached to said lower frame is passed so that said first lever can be rotated around the second connecting means and the fourth connecting means, sliding along the slide hole, and positional relationship among the first, second and fourth connecting means being such that a first acute angle made by a line passing through the points of the first and second connecting means and a line passing through the points of the second and fourth connecting means increases when said upper frame is opened.

a rotation shaft provided to said upper frame in parallel with the first direction;

a second lever attached to said rotatory shaft, said second lever having fifth connecting means at the end thereof;

a link member connecting the first arm of said first lever and said second lever through the third connecting means and the fifth connecting means respectively, for transferring the rotating motion of said first lever to said rotation shaft so that when the first acute angle increases in accordance with the opening of said upper frame, a second acute angle made by a line passing through the positions of an axis of said rotatory shaft and the first connecting means and a line passing through the positions of the axis of said rotatory shaft and said second lever increases;

first spring lever means, attached to said rotatory shaft, for pushing said developing unit toward the cylindrical surface in the second direction so as to have the first gap between said developing unit and the cylindrical surface when said upper frame is closed, decreasing the second acute angle; and second spring lever means, attached to said rotatory shaft, for separating said developing unit from the cylindrical surface in the second direction so as to have the second gap between said developing unit and the cylindrical surface when said upper frame is opened, increasing the second acute angle.

4. A linkage mechanism provided between first and second frame members, of an image forming apparatus, which are movable relative to each other between open and closed positions, one of the frame member carrying a developing unit and an image forming drum, comprising:

linkage means coupled to both the first and second frame members, and being movable in response to relative movement between the first and second frame member; and sliding means for slideably supporting the developing unit in the one frame member, and being actuated by the linkage means for movement between first and second positions.

5. A linkage mechanism according to claim 4, wherein the first and second frame members are connected for pivotal movement relative to each other.

6. A linkage mechanism according to claim 5, wherein the linkage means includes a first pivotal lever operatively coupled to the sliding means and being operative to impart sliding movement to the sliding means in response to relative pivotal movement between the first and second frame members.

7. A linkage mechanism according to claim 6, wherein the linkage means includes a second pivotal lever pivotally connected between the first and second frame members, and being operative to impart pivotal movement to the first pivotal lever in response to relative pivotal movement between the firs and second frame members.

8. A linkage mechanism according to claim 7, further comprising a link connecting the first and second pivotal levers.

9. A linkage mechanism according to claim 7, wherein the second pivotal lever has a slot formed at one end providing a sliding, pivotal connection between the first and second frame members.

10. A linkage mechanism according to claim 6, wherein the first pivotal lever includes a first flat spring for pushing the sliding means towards the image forming drum and a second flat spring for pulling the sliding means away from the image forming drum.

11. A linkage mechanism according to claim 10, further comprising a spacer disposed between the first and second flat springs.

* * * * *

UNITED STATES PATENT AND TRADEMARK OFFICE

CERTIFICATE OF CORRECTION

PATENT NO. : 5,045,885

DATED : Sept. 3, 1991

INVENTOR(S) : Nishio

It is certified that error appears in the above-identified patent and that said Letters Patent is hereby corrected as shown below:

Title page, under Related U.S. Application Data, change "Sept. 9, 1988" to --Sept. 28, 1988--.

Col. 1, line 14, after "ticularly" insert a comma and delete "a" (second occurrence).

Col. 2, line 45, change "users" to --user--.

Col. 4, line 36, change "repeat" to --repeating--.

Col. 7, line 19, change "25b" to --252b--;
line 27, change "11" to --211--.

Col. 8, line 57, change "doming" to --forming--.

Col. 9, line 21, change "opened." to --opened;--.

Signed and Sealed this

Thirteenth Day of April, 1993

*Attest:*

STEPHEN G. KUNIN

*Attesting Officer*

*Acting Commissioner of Patents and Trademarks*